United States Patent [19]

Lee

[11] Patent Number: 4,979,473

[45] Date of Patent: Dec. 25, 1990

[54] PISTON COOLING NOZZLE

[75] Inventor: Thomas R. Lee, Columbus, Ind.

[73] Assignee: Cummins Engine Company, Inc., Columbus, Ind.

[21] Appl. No.: 424,868

[22] Filed: Oct. 20, 1989

[51] Int. Cl.[5] ..... F01P 1/04

[52] U.S. Cl. ..... 123/41.35; 239/600

[58] Field of Search ..... 123/41.34, 41.35, 41.42; 92/186; 239/450, 597, 600

[56] References Cited

U.S. PATENT DOCUMENTS

| | | | |
|---|---|---|---|
| 3,709,109 | 1/1973 | Howe | 123/41.35 |
| 4,067,307 | 1/1978 | Hofle et al. | 123/41.35 |
| 4,128,110 | 12/1978 | Haytayan | 251/900 |
| 4,206,726 | 6/1980 | Johnson, Jr. et al. | 123/41.35 |
| 4,508,065 | 4/1985 | Suchdev | 123/41.35 |

OTHER PUBLICATIONS

Sep. 1989 publication "E7 vs. E6 Product Comparison Bulletin" (Mack, Truck).

*Primary Examiner*—Noah P. Kamen

*Attorney, Agent, or Firm*—Sixbey, Friedman, Leedom & Ferguson

[57] ABSTRACT

A piston cooling assembly for cooling each of the pistons in an internal combustion engine is provided. The piston cooling assembly of the present invention, which directs a spray of cooling fluid, typically oil, to a selected targeted area of the piston with which it is associated, is installed, adjusted and removed entirely from the exterior of the engine block. The piston cooling assembly is received in a specially configured bore in the engine block and includes a flange located exteriorly of the engine block to position and secure the assembly in its desired location. A nozzle tube support attached to the flange is sealingly engaged within the engine block bore and is fluidically connected with the engine cooling fluid supply to provide a supply of cooling fluid to a nozzle tube. The nozzle tube, one end of which is supported by the nozzle tube support, sprays cooling fluid toward the targeted piston area. In an alternate embodiment, a second nozzle tube is provided to direct coolant and/or lubricant to the joint between the piston and the connecting rod.

15 Claims, 3 Drawing Sheets

PISTON COOLING NOZZLE

TECHNICAL FIELD

The present invention relates generally to devices for cooling the pistons of internal combustion engines and specifically to a targeted piston cooling nozzle.

BACKGROUND ART

The cooling of the reciprocating pistons of an internal combustion engine with cooling fluids, including oil is well known. The use of oil can be quite effective in reducing piston temperature and may also lubricate the piston as well. However, the various devices currently available for directing oil or other cooling fluids toward the piston do not reliably achieve optimum cooling. Unless the device used to direct the oil to the piston can be precisely positioned so that the cooling oil is sprayed or otherwise applied substantially uniformly to all of the piston surfaces to be cooled, localized "hot spots" may be created, and cracking of the piston could result from the temperature differentials thus produced.

This problem may be particularly pronounced when the piston to be cooled is a gallery type or articulated piston with a central cavity that is open at the end toward the connecting rod. The various internal piston structures and the connecting rod are likely to interfere with the application of cooling oil to the interior of the piston, particularly while the piston is reciprocating in the cylinder during engine operation.

The application of cooling oil to the piston interior has been accomplished in different ways by the prior art. For example, in Johnson, Jr. et al. U.S. Pat. No. 4,206,726, a piston cooling nozzle is mounted through a hole in the engine block. Several retainer plates are used to hold the nozzle in place on the engine block and to ensure proper orientation of the nozzle jets. The nozzle shaft intersects an oil gallery in the engine block to provide oil under pressure to the nozzle jets. This arrangement directs cooling oil to the piston interior and can be aligned to provide a cooling oil spray to this part of the piston to cool it during engine operation. However, the piston cooling nozzle and retainer plates described in Pat. No. 4,206,726 must be installed, adjusted and removed from the interior of the engine block, which involves removing the engine side cover. Consequently, there is no way to determine whether the nozzle is correctly aligned to direct an optimal spray of cooling oil to the piston interior without removing the engine side cover. The installation, maintenance and replacement of such a piston cooling nozzle, therefore, is both labor intensive and costly.

The prior art also discloses other piston cooling nozzles and similar devices. U.S. Pat. Nos. 3,709,109 to Howe; 4,067,307 to Hofle et al.; and 4,508,065 to Suchdev are illustrative of the prior art relating to such piston cooling structures. The selectively rotatable piston nozzle disclosed in Pat. No. 3,709,109 can be mounted to selectively direct a spray of cooling oil against a desired portion of the piston. However, this piston nozzle is installed inside the engine block during manufacture of the engine. Adjustment of the nozzle after installation to insure that oil is being sprayed to the piston at a location and in a manner that will achieve optimal cooling is extremely difficult with this design.

Suchdev Pat. No. 4,508,065 discloses a piston cooling delivery tube including a bracket attached to the cylinder liner in a predetermined fixed position. The tube is prealigned to direct the cooling oil to a particular location. As a result, if the tube becomes misaligned so that the cooling spray is not directed to the optimum location, correction of the adjustment can only be achieved by disassembling the engine block.

There is no disclosure in Pat. No. 4,067,307 of how the piston cooling nozzle described in that patent is mounted on the engine block or whether it may be adjusted to direct a spray of cooling oil toward a piston to achieve optimal cooling.

The piston cooling nozzles of the prior art are not as effective as desired at providing a precisely directed spray of cooling oil to achieve optimal cooling of an articulated or gallery piston in a high horsepower engine. While these nozzles may perform an adequate cooling function for some types of pistons and engines, their long-term reliability is difficult to insure. The prior art piston nozzles that are targeted to direct cooling oil to a specific area of the piston and, therefore, can provide optimum cooling even of articulated pistons in high horsepower engines are mounted from the inside of the engine block. Consequently, if one of these targeted piston nozzles becomes misaligned so that the cooling oil spray is not directed to the desired location, the only way to correct the misalignment is to disassemble at least a portion of the engine block. None of the targeted piston cooling nozzles of the prior art is readily accessible from the outside of the engine block. As a result, the cost of installing, maintaining, and replacing such devices can be quite high.

Piston cooling devices that can be mounted from the outside of the engine block and thus avoid the costly and time consuming maintenance problems described above are available. The nozzle disclosed in Pat. No. 3,709,109 is an example. However, this nozzle is not targeted or aligned to insure that a spray of cooling oil or fluid will be directed to a specific area of the interior of a gallery type piston to produce optimum piston cooling in a high horsepower internal combustion engine. Further, because the piston cooling nozzle of Pat. No. 3,709,109 is rotatable to move it from an actuated to a deactuated condition, it may rotate away from its optimal actuated position so that cooling oil is not directed to the proper location. Such mis-direction may go undetected for a sufficiently long period that uneven cooling of the piston and its associated problems occur.

The prior art, therefore, fails to provide a precisely targeted piston cooling assembly that may be easily installed, serviced and replaced from outside of the engine block to reliably insure the direction by the nozzle of a spray of cooling oil to a specific location in an articulated or gallery piston that will achieve optimum piston cooling in a high horsepower engine.

SUMMARY OF THE INVENTION

It is a primary object of the present invention, therefore to overcome the disadvantages of the prior art and to provide a piston cooling assembly including a targeted piston nozzle for cooling a piston in a high horsepower internal combustion engine that is mounted from the outside of the engine block.

It is another object of the present invention to provide a piston cooling assembly including a targeted piston cooling nozzle that may be precisely located and positioned from outside the engine block to optimally cool an articulated or gallery piston.

It is a further object of the present invention to provide a piston cooling assembly including integral structure that permits, from outside the engine block, the accurate positioning of the nozzle to direct a spray of cooling oil to an optimum area of a gallery piston inside the engine block.

It is yet a further object of the present invention to provide a stepped piston cooling assembly receiving bore in the block of an internal combustion engine to enhance the effectiveness of the assembly's seal.

It is a still further object of the present invention to provide an easily installed, easily maintained piston cooling assembly including a targeted piston cooling nozzle capable of effectively cooling a high horsepower internal combustion engine.

The aforesaid objects are achieved by providing a piston cooling assembly including a targeted nozzle tube supported and fluidically received by a nozzle support configured to engage a stepped bore specially formed in the engine block to receive the piston cooling assembly. Oil is supplied to the nozzle assembly by an oil supply gallery intersected by the engine block bore, which is sealed to prevent the leakage of oil to the inside or to the outside of the block from the piston cooling oil supply. The piston cooling assembly further includes a flange secured at the opposite end of the nozzle support from the nozzle tube. The flange includes positioning means that engage corresponding positioning means on the engine block to locate the piston cooling nozzle so that the nozzle tube is properly oriented and aligned to direct a spray of cooling oil at the desired target inside a gallery-type piston.

Other objects and advantages will be apparent from the following description, claims and drawings.

BEST MODE FOR CARRYING OUT THE INVENTION

The cooling of articulated or gallery type pistons in high horsepower engines has been found to be optimally accomplished by spraying a cooling fluid, preferably oil, so that it contacts an area of the piston where it will achieve uniform cooling of the piston. If the piston is not cooled uniformly, some areas will stay at undesirably high temperatures while others will be cooled. These temperature differentials will produce uneven cooling likely to lead to cracks and structural defects in the piston which, at best, can weaken it and, at worst, can render it inoperable. The present invention provides a piston cooling assembly including a targeted piston nozzle capable of providing a spray of oil or other cooling fluid to a desired area of the piston which can be installed in a precisely aligned position relative to the piston, maintained and removed from the exterior of the engine block.

Figure 1:
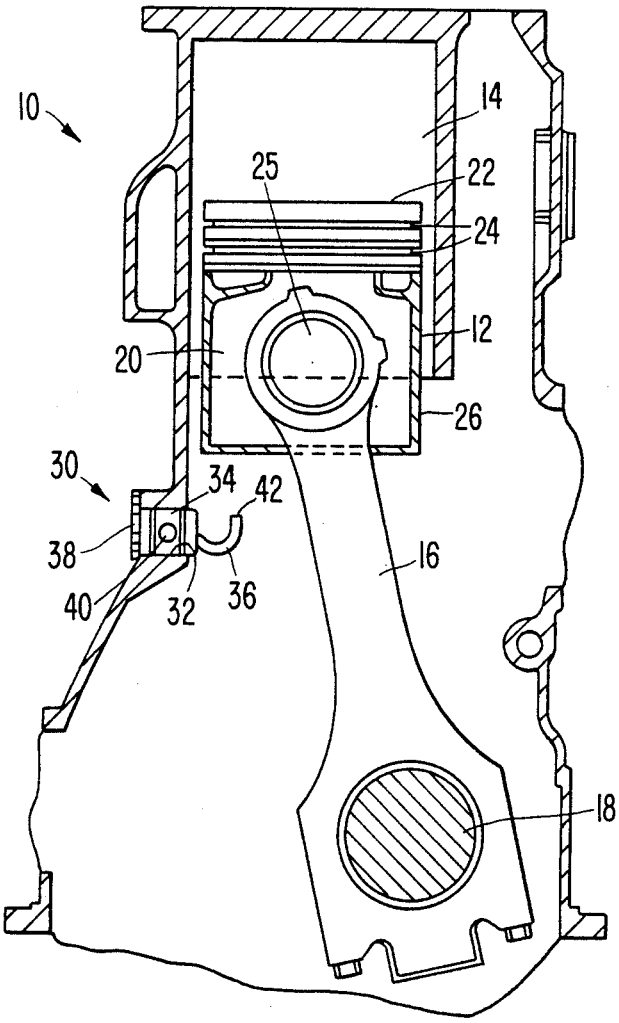
FIG. 1 is a cross-sectional diagrammatic view of a portion of an internal combustion engine showing the present invention mounted in place.

Referring to the drawings, FIG. 1 illustrates diagrammatically in cross-sectional view a portion of an internal combustion engine. FIG. 1 shows the present piston cooling assembly installed in place in the block of an engine. Only one cooling assembly and piston are shown. One complete piston cooling assembly including a targeted nozzle would be provided for cooling each piston.

The portion of the engine block 10 shown in FIG. 1 includes a piston 12 reciprocably received within a cylinder 14. A connecting rod 16 is journalled to the piston in a suitable manner, such as, for example, with a wrist pin or ball joint 25, at one end and attached to the crank shaft 18 at the other end. The type of piston with which the present invention is most effective has a central cavity 20, a crown portion 22 which receives piston rings 24 and a depending skirt portion 26. The piston is cooled as it reciprocates by the application of a spray of cooling oil from the piston cooling assembly 30 of the present invention. The piston cooling assembly 30 is shown within the circled area in FIG. 1 and in greater detail in FIGS. 2 to 5.

A bore 32, formed in the engine block 10, is configured to receive a nozzle body or support 34. The nozzle support 34 includes a bore 40 which intersects an oil gallery (not shown) in the engine block to provide cooling oil to a nozzle tube 36. A flange 38 secured to the nozzle support 34 at the end opposite the nozzle tube 36 attaches the assembly 30 to the engine block. The flange 38 also assists in aligning the assembly within the block so that the oil directed from the terminal end 42 of the nozzle tube will be directed to a desired targeted location on the piston.

Such a nozzle is generally referred to as a targeted piston cooling nozzle because the cooling spray is directed to a particular location to achieve optimal piston cooling. Targeted piston cooling nozzles, however, must be precisely positioned and installed in a manner that maintains the proper nozzle position required to spray the "target". As discussed above, until the present invention it was necessary to open the engine block to install a targeted piston cooling nozzle so that it would be properly aligned to spray cooling oil to the desired piston location.

Figure 2:
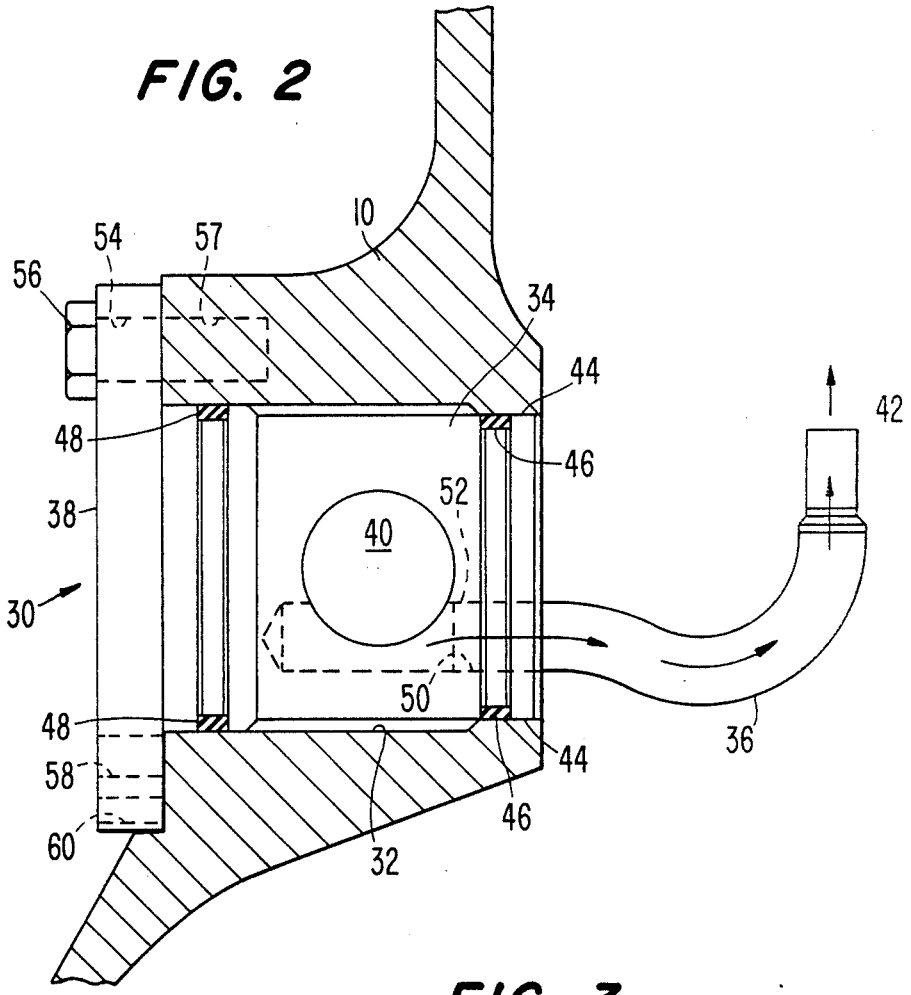
FIG. 2 is an enlarged view of the circled portion of FIG. 1 showing the present piston cooling assembly.

FIG. 2 illustrates an enlarged view of the circled portion of FIG. 1 and shows the present piston cooling assembly in greater detail. The bore 32 in the engine block 10 preferably has a diameter sufficient to allow the insertion of the nozzle support 34 and nozzle tube 36 without undue difficulty, yet provides a tight enough fit for the nozzle body so that extraordinary measures do not have to be taken to seal the assembly to prevent oil leakage. One way in which this can be accomplished is to form an integral circumferential ridge 44 at the end of the bore 32 adjacent to the interior of the engine block, thus giving the bore a stepped configuration. The diameter of the ridge 44 is smaller than the diameter of the remainder of the bore.

A pair of sealing elements 46,48 is provided to seal the nozzle body 34 in the engine block bore 32. The sealing elements prevent the leakage of oil intended to cool the piston from around the nozzle body 34. Since this oil is supplied under pressure, an effective seals are required to insure that oil does not leak, but is available for cooling purposes. The sealing element 46 is the interior sealing element and is located adjacent to the lip portion 44 at the interior end of the engine block bore 32. The sealing element 48 is the exterior sealing element and is located near the exterior end of the engine block bore 32. As will be explained in greater detail in connection with FIG. 3, the nozzle support 34 is specially configured to receive the sealing elements 46 and 48 and hold them in place. Circumferential recesses or seal-receiving grooves 68,70 (FIG. 3) are integrally formed in the nozzle support 34 to receive these sealing elements. The sealing elements 46 and 48 may be formed from conventional O-rings or any other similar structure or material useful for sealing oil under pressure in an internal combustion engine environment. Good sealing results have been achieved by forming the interior or exterior seal entirely of plastic, for example.

The nozzle support 34 receives and holds the nozzle tube 36 in place while, at the same time, providing a fluid connection between the nozzle tube and the engine cooling oil supply. Bore 40 in nozzle support 34 fluidically connects the piston cooling assembly 30 with this supply of cooling oil. Typically, an oil gallery (not shown) is provided in the engine block to supply cooling oil to each piston. A nozzle tube receiving bore 50 is formed in the nozzle support 34 to receive one end 52 of the nozzle tube. The bore 50 extends into the body of the nozzle support 34 to intersect the oil supply bore 40. Cooling oil is thus conveyed along the path shown by the arrows in FIG. 2 from the nozzle support bore 40 into nozzle tube receiving bore 50 and from there through the nozzle tube 36 and out through the nozzle tube tip 42.

The shape of the nozzle tube 36 is selected to direct a spray of cooling oil to a location which will produce optimal cooling. The gently curved configuration shown in the drawings has been found to produce effective cooling. Because optimum cooling of a gallery type piston is produced when the cooling spray is directed upwardly, the preferred nozzle tube configuration for this application is that shown in the drawings. The tube configuration should also be selected to produce a spray from the tip 42 that will have the desired effect. However, other configurations that will direct a spray of cooling oil to a desired piston location could also be employed.

The nozzle tube 36 and nozzle support 34 are shown in the drawings as two separate structures. It is preferred to form these structures of a metal capable of withstanding the temperatures, pressures and potentially corrosive chemicals typically encountered in the environment of an internal combustion engine. However, other materials, such as, for example, some of the strong inert plastics currently available, could also be used to form the nozzle tube and nozzle support. In addition, the integral formation of the nozzle tube 36 and nozzle support 34 as a one-piece rather than a two-piece element is contemplated to be within the scope of the present invention. Whatever the configuration or material chosen, the assembly must be capable of being mounted in place from the outside of the engine block to position the nozzle tube 36 relative to the piston so that cooling oil is directed by the nozzle tube spray tip 42 to a targeted piston location.

The flange 38 of the present piston cooling assembly 30 remains completely outside the engine block after the assembly, is installed to facilitate alignment and to secure the assembly in place. Three bores are provided to insure the proper installation, alignment and removal of the assembly from the engine block 10. A capscrew receiving bore 54 receives a capscrew 56 which is threaded into a suitable recess 57 in the engine block. A threaded pullout bore 58 receives a threaded tool (not shown) to facilitate the removal of the assembly from the engine block. A locating pin bore 60 receives a positioning dowel pin (not shown) formed on the engine block to orient the nozzle support 34 within the engine block bore 34 and, thus, the nozzle tube 36 with respect to its desired target.

Figure 3:
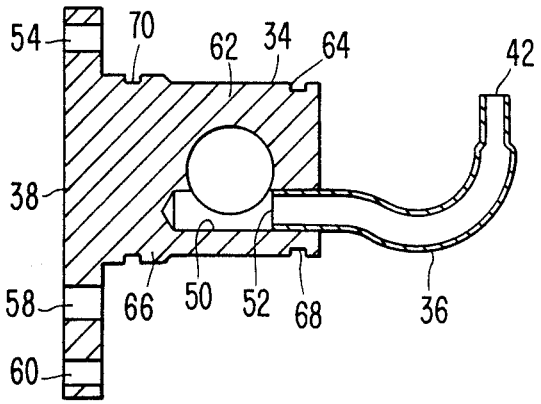
FIG. 3 is a cross-sectional view of the piston cooling assembly of the present invention.
Figure 4:
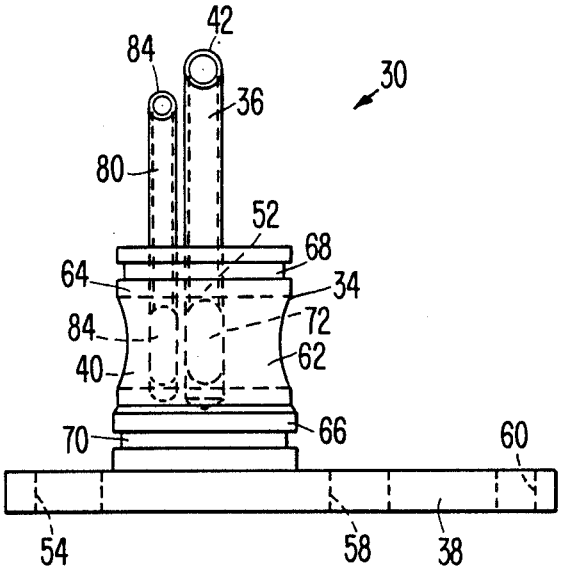
FIG. 4 is a top view of the present piston cooling assembly.

FIGS. 3 and 4 illustrate preferred configurations of the nozzle support 34. The nozzle support preferably includes a central body section 62, an interior section 64 and an exterior section 66. The central body section 62 includes the bore 40 which intersects the engine cooling oil supply (not shown) to provide oil to the nozzle tube. The central body section may have the concaved curved configuration shown in FIG. 4, the substantially block-like shape shown in FIG. 3 or any other shape which effectively accommodates the bore 40 and supports the nozzle tube 36 in a manner which provides a fluid connection between the bore 40 and the nozzle tube 36.

The interior section 64 of the nozzle support 34 includes a circumferential seal receiving recess or groove 68 to receive and secure in place the interior sealing element 46. The exterior section 66 includes a second circumferential seal receiving recess or groove 70, which provides a seat for the exterior sealing element 48.

FIG. 4 illustrates the present piston cooling assembly as viewed from above the piston looking downward toward the crankshaft. The location and shape of the oil-receiving bore 72 which provides a fluid connection between bore 40 and the nozzle tube 36 can be seen clearly in FIG. 4.

FIG. 4 also shows an alternate embodiment of the piston cooling assembly of the present invention. In this embodiment, a second nozzle tube 80 is provided in the nozzle support 34, adjacent to and substantially parallel to the nozzle tube 36. This second nozzle tube 80, includes an oil-receiving bore 82 which provides a fluid connection between the oil supply bore 40 and the tube 80. Oil is directed from the tip 84 of tube 80 to cool and/or lubricate the wrist pin or ball joint 25 (FIG. 1).

Figure 5:
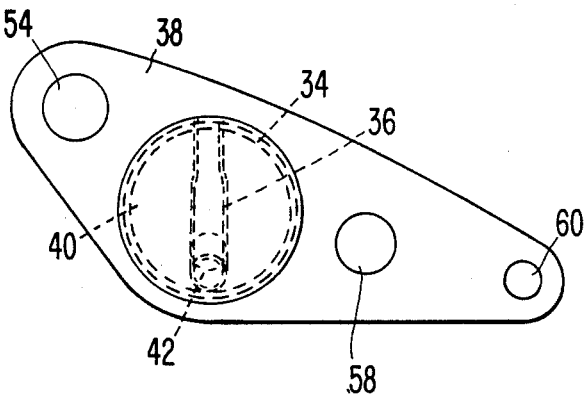
FIG. 5 is a side view of the present piston cooling assembly.

FIG. 5 illustrates an uninstalled piston cooling assembly according to the present invention as it would appear when viewed from outside the engine block toward the exterior surface of the flange 38. The shape of the flange 38 has been selected to conform to the exterior of the engine block. The locating hole 60, as previously mentioned, receives a corresponding positioning dowel pin (not shown) located on the engine block to fix the piston cooling assembly in a position where the nozzle tube will direct a spray of cooling oil to the desired target when the assembly is installed from the exterior of the engine block. The direction of the spray of cooling oil can be adjusted, if required, by changing the location of the dowel pin, by adjusting the position of the tip 42 of the nozzle tube 36 relative to the nozzle support 34 or by both.

The present piston cooling assembly is easily installed from outside the engine block with a minimum of effort. To install the present piston cooling assembly, sealing elements are seated in place in the grooves 68 and 70 of the nozzle support 34. The tip end 42 of the nozzle tube 36 is then inserted through the engine block bore 32 to the interior of the block, and the nozzle support 34 is pressed into the bore 32 so that the interior seal element 46 engages the ridge 44. The assembly is rotated within the bore until the locating hole 60 in the flange 38 receives the engine block positioning dowel pin (not shown). The entire assembly is then secured in place with the capscrew 56. The assembly may be removed simply by reversing the procedure. This facilitates adjustment of the nozzle tube, replacement of the sealing elements, cleaning of the assembly and any other maintenance required to be performed. As a result, the cost of installing, maintaining and replacing the present assembly is substantially lower than previously available piston cooling devices.

INDUSTRIAL APPLICABILITY

The present invention will find its primary application in a high horsepower, oil cooled internal combustion engine with gallery or articulated type pistons.

I claim:

1. An assembly for cooling a piston in an internal combustion engine by directing a spray of cooling fluid from the engine cooling fluid supply to a portion of the piston selected to achieve the optimum cooling of the entire piston, wherein said assembly includes:

a. nozzle tube means for directing the spray of cooling fluid to the selected portion of the piston, wherein said nozzle tube means comprises a tube including a base, an upwardly curved arm and a tip, wherein said base is received and supported in nozzle tube support means to fluidically connect with the engine cooling fluid supply, said arm directs cooling fluid to said tip, and said tip sprays cooling fluid upwardly toward the selected portion of the piston;

b. nozzle tube support means mountable within the engine block proximate to said piston from the exterior of said block for receiving and supporting said nozzle tube means and for providing a fluid connection between the engine cooling fluid supply and the nozzle tube means; and c. flange means, including locator means for positioning the assembly from the exterior of the engine block so that said nozzle tube means directs the spray of cooling fluid to said selected portion, for facilitating the attachment and removal of the assembly from the engine block exterior.

2. The piston cooling assembly described in claim 1, wherein said nozzle tube support means includes central passage means for providing a fluid connection between the engine cooling fluid supply and the nozzle tube means.

3. The piston cooling assembly described in claim 2, wherein said nozzle tube support means further includes a pair of spaced sealing means to prevent the leakage of cooling fluid from said nozzle support means.

4. The piston cooling assembly described in claim 3, wherein said sealing means includes an interior sealing element located adjacent to the engine block interior and an exterior sealing element located adjacent to the engine block exterior.

5. The piston cooling assembly described in claim 4, wherein said interior sealing element and said exterior sealing element each comprises an O-ring.

6. The piston cooling assembly described in claim 4, wherein one or both of said exterior and said interior sealing elements comprises a plastic sealing member.

7. The piston cooling assembly described in claim 1, wherein said locator means comprises a bore in said flange means configured to receive a locator pin formed on the exterior of the engine block.

8. The piston cooling assembly described in claim 3, wherein said nozzle tube support means includes a pair of integrally formed sealing element receiving recesses to hold said sealing means securely in place when said nozzle tube support means is correctly positioned within the engine block.

9. The piston cooling assembly described in claim 1, wherein said flange means is formed integrally with the nozzle tube support means.

10. The piston cooling assembly described in claim 1, wherein the assembly is received in a stepped bore in the engine block including a circumferential ridge located adjacent to the engine block interior.

11. The piston cooling assembly described in claim 1, further including a second nozzle tube means supported by said nozzle tube support means for cooling and/or lubricating a second selected portion of said piston.

12. A high horsepower oil cooled internal combustion engine including a plurality of articulated pistons mounted for reciprocating movement within the block of the engine and a plurality of piston cooling assemblies, one of said assemblies being mounted in a specially configured bore in the engine block adjacent to each piston; each said assembly including nozzle tube means comprising a tube including a base, an upwardly curved arm and a tip, and said base is fluidically connected with a supply of engine oil for directing a spray of cooling oil to a targeted portion of said piston, thereby optimally cooling said piston; each assembly further including flange means located exteriorly of the engine block for facilitating the attachment to and removal of the assembly from the engine block exterior, wherein each said assembly is precisely positioned so that the nozzle tube means directs cooling oil to said targeted portion from the exterior of the engine block.

13. The internal combustion engine described in claim 12, wherein said engine block includes on the exterior thereof a plurality of positioning means for precisely positioning each of said plurality of piston cooling assemblies to direct cooling oil to said targeted portion.

14. The internal combustion engine described in claim 13, wherein each of said flange means located exteriorly of the engine block receives one of said positioning means and guides said assembly into the correct position within the engine block bore; and each of said plurality of piston cooling assemblies includes nozzle tube support means located substantially entirely within the engine block bore for supporting said nozzle tube means and for providing a fluid connection between the engine cooling oil and said nozzle tube means.

15. The internal combustion engine described in claim 12, wherein each of said piston cooling assemblies includes secondary cooling and lubricating means for directing oil to a second portion of said piston.

* * * * *